US006799832B1

(12) United States Patent
Adavikolanu et al.

(10) Patent No.: US 6,799,832 B1
(45) Date of Patent: Oct. 5, 2004

(54) ALLOY AND ORIFICE PLATE FOR AN INK-JET PEN USING THE SAME

(75) Inventors: Srinivas Adavikolanu, Hillbrooks (SG); Kar Hoong Poon, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 443 days.

(21) Appl. No.: 09/586,526

(22) Filed: Jun. 2, 2000

(30) Foreign Application Priority Data

May 19, 2000 (SG) ..... 200002758

(51) Int. Cl.[7] ..... B41J 2/135; B41J 2/17; C25D 3/56

(52) U.S. Cl. ..... 347/45; 347/47; 205/102; 205/109; 205/150; 205/152; 205/238

(58) Field of Search ..... 205/102, 103, 205/104, 109, 149, 150, 152, 158, 238; 347/45, 47

(56) References Cited

U.S. PATENT DOCUMENTS 3,616,286 A * 10/1971 Aylward et al. ..... 205/83
4,033,833 A * 7/1977 Bestel et al. ..... 205/104
4,436,595 A * 3/1984 Matson ..... 205/101

FOREIGN PATENT DOCUMENTS

JP 07052382 A * 2/1995 ..... B41J/2/045

* cited by examiner

*Primary Examiner*—James J. Seidleck
*Assistant Examiner*—Thao Tran

(57) ABSTRACT

An alloy that is suitable for coating a nickel orifice plate of an ink-jet printhead so as to allow the orifice plate to adhere to an intermediate layer of the ink-jet printhead and to improve the non-wetting characteristics of the nickel orifice plate is disclosed. This alloy is made up of a precious metal and a polymer material. According to a one embodiment, the precious metal is gold and the polymer is Teflon. An orifice plate for an ink-jet pen that can be coated with the alloy typically has a plate that has an inner surface and an outer surface. The orifice plate has an orifice that extends through the plate between the inner surface and outer surface. At least a portion of the outer surface surrounding the orifice is coated with the precious metal-polymer alloy.

14 Claims, 2 Drawing Sheets

ALLOY AND ORIFICE PLATE FOR AN INK-JET PEN USING THE SAME

FIELD OF THE INVENTION

This invention relates to an alloy that is suitable for coating orifice plates used with ink-jet pens to make the surface of the orifice plates non-wetting. More particularly, this invention relates to a precious metal-polymer alloy and orifice plates coated with the alloy. A non-wetting surface of an orifice plate minimizes puddling of ink in areas around orifices on the orifice plate and thus improves the print quality achievable with the orifice plate.

BACKGROUND

A prior art ink jet printer typically includes a printing cartridge or ink-jet pen in which small droplets of ink are formed and ejected toward a printing medium. Such an ink-jet pen includes-an orifice plate having very small nozzles or orifices through which the ink droplets are ejected. Adjacent to the orifices inside the ink-jet pen are ink chambers, where ink is stored prior to ejection.

Ejection of an ink droplet through an orifice may be accomplished by an associated drop ejection system. This drop ejection system is responsible for supplying ink to the ink chamber and quickly heating a volume of ink within the ink chamber on demand. The rapid expansion of ink vapor forces a drop of ink through the orifice. This process is called "firing." The ink in the chamber may be heated with a transducer, such as, a resistor that is aligned adjacent to the orifice.

Whenever an ink drop is ejected through an orifice, a trailing portion or "tail" of ink moves with the drop. A small amount of the ink tail may separate and land on the outer surface of the orifice plate as an ink droplet. Due to this separating of the ink tail, some of the ink that is ejected through the orifice does not reach the printing medium (such as paper), and instead collects on the outer surface of the orifice plate facing the printing medium. Some of this residual ink accumulates or puddles adjacent to the edge of the orifice. This puddle of residual ink may alter the trajectory of the subsequently ejected drops to cause an effect commonly known to those in the art as ink spray. Ink spray reduces the quality of a printed image.

Residual ink on the outer surface of the orifice plate also tends to trap stray particles, such as paper fibers. The fibers may be held by the ink near the orifice to partially block the orifice and interfere with ink drop ejections. Further, residual ink on the outer surface of the orifice plate may collect near the orifice into a thin sheet that is in fluid communication with ink stored in an ink chamber that is adjacent to the orifice. As a result, a continuous ink path between the ink chamber and the outer surface of the orifice plate may be formed. This path promotes ink leakage through the orifice. The prior art orifice plate of nickel or nickel coated with gold is susceptible to such puddling of ink. Accordingly, the outer surface of an ink-jet pen orifice plate should preferably be designed so that ink does not puddle in the vicinity of the orifice or accumulate on the orifice plate in an amount that traps fibers and facilitates leakage as mentioned above.

In the prior art, different methods using materials which are less wettable than gold have been used to address this ink puddling problem. In one of these methods, selected portions of the orifice plate outer surfaces are formed to have wetting and non-wetting surface characteristics for minimizing puddling to reduce spray. Specifically, an outside surface portion immediately surrounding the orifice edge is coated with a non-wetting fluorocarbon polymer such as that manufactured under the trademark Teflon by DuPont. This non-wetting surface causes any residual ink droplets to bead on that surface away from the edge of the orifice so that the residual ink does not interfere or come into contact with the drops that are later ejected from the orifice.

This method works but suffers a disadvantage. The process that is used to coat the polymer can only deposit a relatively thin layer (less than 1 micron) of the polymer material on the orifice plate. This thin layer of polymer material does not last. In use, this layer of polymer material wears off and puddling will again occur on the surface surrounding the edge of the orifice.

In another method experimented, orifice plates are coated with a layer of nickel-Teflon alloy up to several microns thick using an electroless deposition process. The performances of the ink-jet pens with such a coating exhibit better non-wetting characteristics than those with gold-plated orifice plates. Puddling is reduced and spray is almost eliminated in these ink-jet pens. However, these orifice plates also suffer a disadvantage. The nickel in the nickel-Teflon alloy reacts with the ink to cause the orifice plate to delaminate from a barrier layer of an ink-jet pen. As a result of this delamination, the life of an ink-jet pen is reduced.

The prior art therefore creates the need for an improved alloy and an orifice plate coated with the alloy that makes it less susceptible to the problem of ink puddling and at the same time more prone to a longer operational life than nickel-Teflon coated orifice plates.

SUMMARY

According to one aspect of the present invention, an alloy that is suitable for coating a nickel orifice plate of an ink-jet printhead plate is made up of a precious metal and a polymer material. This precious-metal-polymer alloy allows the orifice plate to adhere to an intermediate layer of the ink-jet printhead and improves the non-wetting characteristics of the nickel orifice plate. According to one embodiment, the precious metal is gold and the polymer is Teflon.

According to another aspect of the present invention, an electrodeposition solution for electroplating the precious metal-polymer alloy has a carrier of ions of a precious metal, an acid buffer for maintaining the pH of the solution to be in the range of 2 to 4, suitable conducting salts to improve the conductivity of the electrodeposition solution and a dispersion of Teflon particles.

According to yet another aspect of the present invention, an orifice plate for an ink-jet pen has a plate that has an inner surface and an outer surface. The orifice plate has an orifice that extends through the plate between the inner surface and outer surface. At least a portion of the outer surface surrounding the orifice is coated with the precious metal-polymer alloy.

BRIEF DESCRIPTION OF DRAWINGS

The invention will be better understood with reference to the drawings, in which.

DETAILED DESCRIPTION OF THE PREFERRED EMBODIMENT

Figure 1:
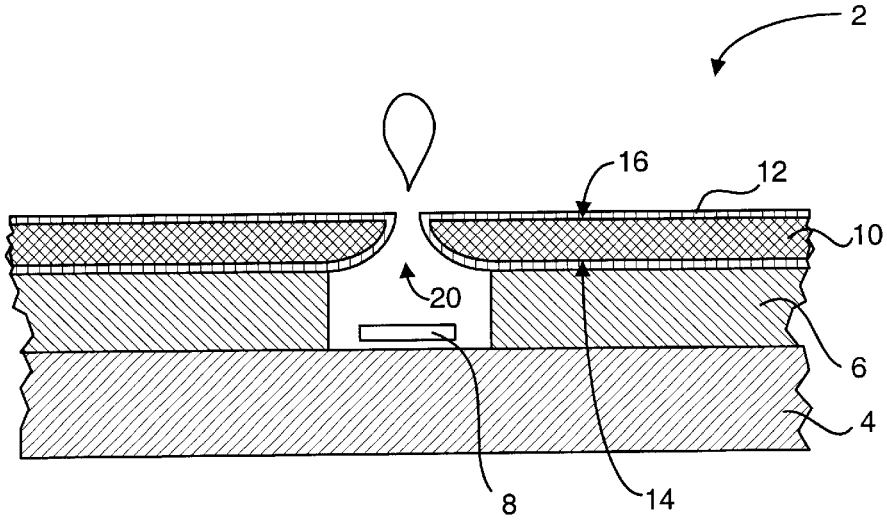
FIG. 1 is an enlarged cross-sectional view of a prior art firing element of an ink-jet printhead. This cross-sectional view shows a portion of an orifice plate that is coated with a layer of gold.

FIG. 1 is a cross-sectional view of a firing element 2 of an ink-jet pen. The firing element 2 includes a substrate 4, an intermediate or barrier layer 6, a transducer 8 and a nickel orifice plate 10 coated with a layer of gold 12. The orifice plate 10 has an inner surface 14 and an outer surface 16. The inner surface 14 of the orifice plate 10 is attached to the intermediate layer 6. The orifice plate 10 has an orifice 20 that extends through the orifice plate 10 between the inner surface 14 and the outer surface 16. This orifice 20 is generally conical in shape.

Figure 2:
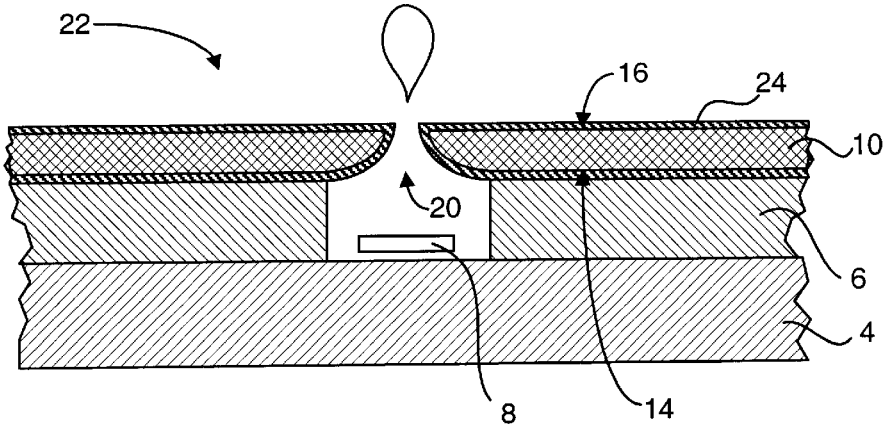
FIG. 2 is a view similar to that in FIG. 1 of a firing element that has an orifice plate coated on both surfaces with a gold-Teflon alloy according to a one embodiment of the present invention.

FIG. 2 shows a firing element 22 of similar structure to that shown in FIG. 1. However, this firing element 22 differs from the firing element 2 in that this firing element 22 includes an orifice plate 10 that is coated with a novel precious metal-polymer alloy 24. Examples of precious metals that can be used in the alloy 24 are gold, rhodium and palladium. The polymer in the alloy 24 is a plastic such as TEFLON, any polyimide, polymethylmethacrylate, polyethyleneterephthalate or mixtures thereof.

In practice, various conventional techniques can be used to coat a nickel orifice plate with the precious metal-polymer alloy 24. Acceptable techniques include both electrodeposition processes and electroless deposition processes.

An example of an electrodeposition process is next described. The nickel orifice plate 10 is first electroformed using methods well known to those skilled in the art, such as forming many orifice plates simultaneously on a mandrel immersed in a solution of Watt's bath containing nickel. After the process of electroforming the nickel orifice plates 10 to a desired thickness, the nickel orifice plates are separated from the mandrel as a sheet of nickel orifice plates 10. This sheet is pre-treated in a 10% v/v hydrochloric or sulfuric acid to remove the oxide layer on the surface of the sheet. Next, the treated sheet 8 is rinsed and coated with a precious metal-polymer alloy 24 such as a gold-Teflon alloy in an electrodeposition process using a preferred electroplating or electrodeposition solution. The sheet of nickel orifice plates 10 forms the cathode and a platinized titanium mesh is used as the anode in an electrodeposition process.

The electrodeposition solution is obtained generally by mixing the following to make up a 10-liter solution:

1.6 grams/liter of potassium gold cyanide 2.5 kg of mixture of conducting salts and acid adjust salts required for maintaining the specific gravity and pH at acceptable levels respectively.

Teflon dispersion-150 ml

Deionized water-10 liters

The first two chemicals are available from any plating chemical manufacturer such as Enthone-OMI Inc. Table 1 shows an example of a composition of the electrodeposition solution.

TABLE 1

Cyanide electrodeposition solution

| Chemical | Concentration |
|---|---|
| Potassium gold cyanide | >0.5 grams/liter, preferably in the range of 0.5 to 2.5 |
| Citric acid/Sodium citrate | 100 grams/liter |
| Ethylene Diamine Tetra Acetic acid (EDTA) | 5–20 milligrams/liter |
| Nickel sulfate | 1–50 milligrams/liter |
| Conducting salts | 100 grams/liter |
| Teflon dispersion | >5 milliliter/liter, preferably in the range of 5 to 25 milliliter/liter |

The potassium gold cyanide is a carrier of gold ions. The citric acid/sodium citrate is an acid buffer. The conducting salts improve the conductivity of the electrodeposition solution. The Teflon dispersion provides Teflon particles in the electrodeposit or coating. The EDTA and nickel sulfate are preferably added to the solution as a complexing agent and for brightening the electrodeposit respectively.

Table 2 below shows the acceptable ranges of operating parameters for the electrodeposition process using the electrodeposition solution in Table 1.

TABLE 2

Operating parameters

| Operating Parameters | Range |
|---|---|
| pH | <6, preferably 2–4 |
| Specific gravity | >15 Baume, preferably in the range of 15–21 Baume |
| Current density | 1–8 ampere/dm$^2$ |
| Plating temperature | 30° C.–50° C. |
| Plating time | 5–15 minutes |

A specific set of operating parameters that was experimented to work for producing an alloy containing a suitable amount of fluorine is given below:

pH=2.9

Specific gravity=21

Plating current=1.6 amps or 4 A/dm$^2$

Plating voltage=4 volts

Temperature=40 degree Celsius

Plating time=4 minutes

The thickness of the Gold-Teflon alloy coating that is deposited depends on the current density and the plating time in the electrodepostion process. It was found that to obtain a 0.6-micron thick coating, current densities of between 1 and 8 A/dm$^2$ and a plating time of about 10 minutes are required for the electrodeposition process.

The coating over the nickel orifice plate 10 thus obtained is analyzed using an X-ray photoelectron spectroscopy method to have the following composition:

Fluorine=38.1%

Oxygen=4.6%

Nitrogen=3%

Carbon=28.3%

Gold=25.9%

The sheet of nickel orifice plates 10 is coated on both the inner and outer surfaces 14, 16. These orifice plates 10 are now ready for assembly on ink-jet pens. Breaking tabs which are also electroformed on the sheet defines the boundaries of each orifice plate 10. The sheet of orifice plates is attached to a mounting tape, such as the Nitto Denko Elep Holder type V-8T available from Nitto Denko Corporation, Tokyo, Japan. The orifice plates are next singulated into individual orifice plates 10 by breaking the sheet along the breaking tabs. The mounting tape holds the singulated orifice plates 10 for further processing. A machine next picks and places each orifice plate 10 over a corresponding printhead die on a wafer (not shown) containing many such dies. Each die includes the substrate 4, intermediate layer 6 and the transducer 8. The wafer and attached orifice plates are put through a "stake and bake" process to cause the orifice plates 10 to adhere to the dies. After the "stake and bake" process, each printhead consisting of a die and an orifice plate 10 is singulated using dice sawing. Each complete pair of orifice plate 10 and printhead die is then ready for attaching to a pen body (not shown) to complete the fabrication of an ink-jet pen. This pen body typically contains an ink reservoir that supplies ink to the printhead.

In use, the novel alloy-coated orifice plate 10 demonstrates improved characteristics compared to prior art orifice plates. For example, the alloy-coated orifice plate 10 is sufficiently resistant to corrosion by water-based printing inks. Also, these orifice plates 10 are generally hydrophobic. Further, the alloy-coated orifice plates 10 resist delamination. These improved characteristics make the ink-jet pens using the alloy-coated orifice plates 10 last longer and able to print high quality images. These alloy-coated orifice plates 10 therefore have distinct advantages over prior art orifice plates.

The ability to print high quality images is the result of the non-wetting characteristics of the gold-Teflon alloy layer 24. The wetting characteristics of a surface may be classified as "wetting" or "non-wetting." Non-wetting means that the surface energy of the surface is much less than that of the liquid (ink) that is in contact with the surface. A surface is generally considered non-wetting if the contact angle between the ink and the surface is greater than 70 degrees. Ink tends to bead on non-wetting surfaces. A wetting surface (that is, with respect to ink) has a contact angle less than 70 degrees. Ink tends to spread across a wetting surface.

Contact angle measurements were conducted for both gold-coated 12 and gold-Teflon alloy coated 24 orifice plates 10 using a contact angle goniometer. Several orifice plates 10 of each type were used for these measurements. For each measurement, one division of deionized water was dispensed on the surface of each orifice plate. This droplet of deionized water was left on the surface for approximately 20 seconds to allow it to stabilize before a measurement was taken. Eight readings for each orifice plate were taken. All eight readings show that gold-Teflon alloy orifice plates have contact angles larger than 70 degrees. The average of these readings is 105.75 degrees. The corresponding readings for gold plated orifice plates are all below 70 degrees having an average of 36 degrees.

Figure 3:
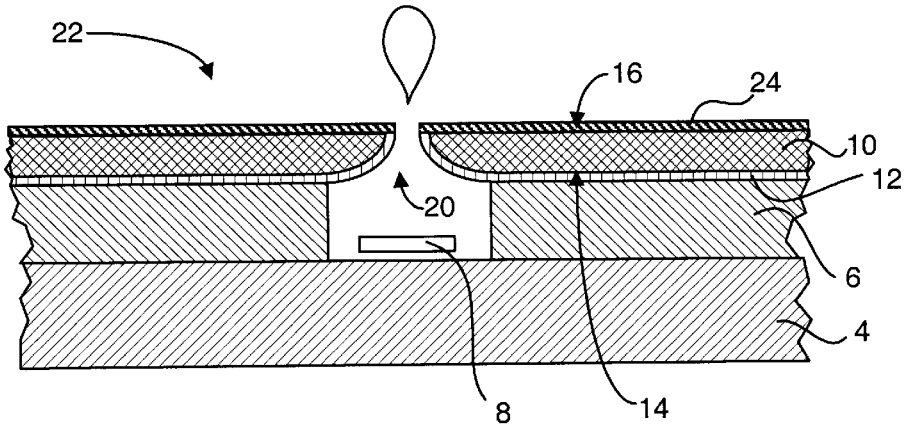
FIG. 3 is a view similar to FIG. 2 showing that only an outer surface of the orifice plate is coated with the gold-Teflon alloy.
Figure 4:
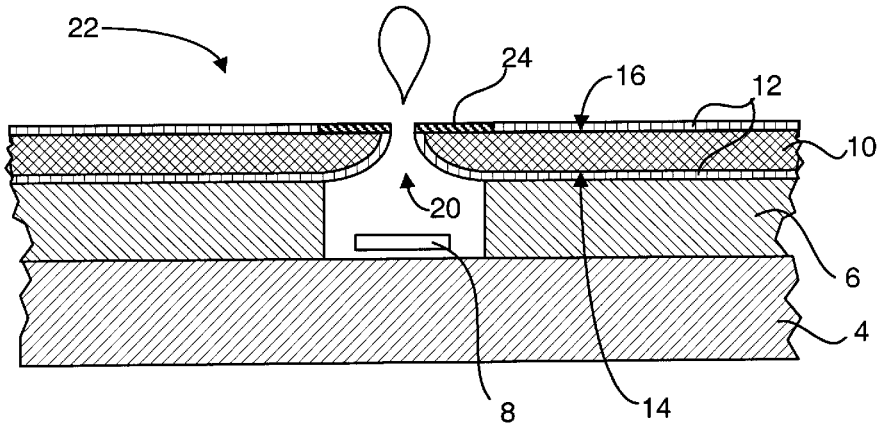
FIG. 4 is a view similar to FIG. 2 showing that only a portion of the outer surface surrounding an orifice is coated with the gold-Teflon alloy.

The manner in which an orifice plate is coated with the alloy 24 should not be construed to be limited to that described where both surfaces 14,16 of a nickel orifice plate 10 are coated. Other methods of coating an orifice plate 10 are possible. For example, the nickel orifice plate 10 can be alloy-coated 24 only on the outer surface 16. In fact, coating only the exposed outer surface 16 of the orifice plate with the gold-Teflon alloy 24 and the inside surface with gold 12 will result in an orifice plate 10 that adheres better to the intermediate or barrier layer 6 and yet exhibits the desirable non-wetting characteristics on the outer surface 16. FIG. 3 shows an orifice plate thus coated. The minimum area on the orifice plate that is required to be coated with the gold-Teflon alloy is the area 26 (FIG. 4) immediately adjacent the orifice edge on the outer surface 16. It is this area 26 on which puddling should be substantially prevented. FIG. 4 shows an orifice plate 10 that is alloy-coated on areas 26 immediately adjacent the orifices 20. Another embodiment that is envisaged to produce good results is an orifice plate as shown in FIG. 4 that is also coated in the orifice between the inner and the outer surfaces. The invention can be practiced in other configurations of side shooter or top shooter printheads and other changes in configurations of printheads.

The process for producing an orifice plate 10 that is coated on one surface with gold and on the other surface with the gold-Teflon alloy is discussed briefly since such a process or variations thereof is well known to those skilled in the art. After the sheet of nickel orifice plates 10 is electroformed and separated from the mandrel as previously discussed, the inside surface 14 is masked and the outer surface 16 is left exposed. The masked sheet is then activated with 10% v/v hydrochloric or sulfuric solution to remove oxide from the exposed surface. Electrodeposition is carried out for the exposed outer surface 16 using the electrodepostion solution previously described. Once the desired thickness of the alloy coating 24 is attained, the sheet of alloy-coated nickel orifice plates is removed and rinsed in deionized water to remove traces of the solution from the sheet. The mask is then removed from the sheet to expose the inner surface 14.

The gold-Teflon coated outer surface is next masked. The exposed inner surface 14 is activated and then gold 12 electroplated using a process and solution well known to those skilled in the art. After coating to a sufficient thickness, the sheet is rinsed and the mask is removed. The sheet is finally post-treated in a spin-rinse-and-dry process. The orifice plates 10 thus formed will have an outer surface 16 that is coated with a gold-Teflon alloy 24 and an inner surface 14 that is coated with gold 12. The orifice plates 10 are then complete and ready for mounting to the printheads according to the process discussed previously.

The orifice plates 10 can also be first coated with gold 12 on both the inner surface 14 and the outer surface 16 and then appropriately coated with a second coating of the gold-Teflon alloy 24.

Although potassium gold cyanide has been used as a carrier of gold ions for the electrodeposition solution, it is envisaged that other carriers of gold ions can also be used in an electrodeposition process. Some examples of these carriers are other cyanide complexing agents and gold sulfite complexes such as sodium gold sulfite, potassium gold sulfite and ammonium gold sulfite. Table 3 below shows an example of an electroplating solution using sodium gold sulfite. Table 4 shows the operating parameters of an electrodeposition process when sodium gold sulfite is used as an electrodeposition solution.

TABLE 3

Sulfite electrodeposition solution

| Chemical | Concentration |
|---|---|
| Sodium gold sulfite | 2.5 liters |
| 5% Potassium hydroxide | 1 liter |
| Sodium arsenite | 100 mg/liter |
| Conducting salts | 750 grams |
| Teflon dispersion | 100–300 ml |
| DI water | 7.5 liters |

TABLE 4

Operating parameters for a sulfite electrodeposition solution

| Operating Parameter | Recommended (Acceptable) range |
|---|---|
| pH | 10 |
| Specific gravity | 20–30 Baume |
| Current density | 1–2 ampere/dm$^2$ |
| Plating temperature | 30° C.–50° C. |
| Plating time | 5–15 minutes |

An example of a composition of a solution that is suitable for an electroless deposition process for a gold-Teflon alloy 24 is given in Table 5 below.

TABLE 5

Composition of Electroless gold-Teflon deposition solution

| Chemical | Concentration |
|---|---|
| Cyanide or sulfite gold salts, e.g. Potassium gold cyanide | 2–100 grams/liter |
| Sodium citrate, dihydrate | 50–100 grams/liter |
| Sodium hypophosphite, Sodium borohydride | 10–50 grams/liter |
| Conducting salts e.g. Ammonium chloride, Sodium chloride etc | 50–100 grams/liter |
| Teflon dispersion | 10–50 milliliters/liter |
| pH | 7–9 |
| Temperature | 60° C.–90° C. |

As previously mentioned, other precious metals such as palladium and rhodium can be used in the alloy. Table 5 and Table 6 below are examples of compositions of electroless deposition solutions using these precious metals.

TABLE 5

Palladium electroless deposition solution

| Chemical | Concentration |
|---|---|
| Palladium chlodire | 2–4 grams/liter |
| Acetic acid | 30–50 milliliters/liter |
| Conducting salts e.g. Sodium chloride etc | 6–8 Baume |
| Teflon dispersion | 10–50 milliliters/liter |
| pH | 3.5–4.5 |
| Temperature | 40° C.–50° C. |

TABLE 6

Rhodium electroless deposition solution

| Chemical | Concentration |
|---|---|
| Rhodium sulfate | 2–4 grams/liter |
| Sulfuric acid | 30–50 milliliters/liter |
| Teflon dispersion | 10–50 milliliters/liter |
| pH | 3–5 |
| Temperature | 35° C.–50° C. |

We claim:

1. An orifice plate for an ink-jet pen comprising:

a plate having a first surface and an opposing second surface;

a plurality of spaced-apart orifices, each of which extends directly through the plate between the first surface and the second surface to define an inlet and an outlet on the first surface and the second surface respectively; and an exposed coating of a precious metal-polymer alloy over at least portions of the second surface surrounding the outlets.

2. An orifice plate according to claim 1; wherein the exposed coating of a precious metal-polymer alloy covers the entire surface.

3. An orifice plate according to claim 1; wherein the exposed coating of a precious metal-polymer alloy covers the first surface, the second surface and surfaces that define the plurality of orifices.

4. An orifice plate according to claim 1; wherein the exposed coating of a precious metal-polymer alloy includes an exposed coating of a gold-Teflon alloy.

5. An orifice plate according to claim 1, further comprising a first coating on the plate beneath the exposed coating of the precious metal-polymer alloy.

6. An orifice plate according to claim 5, wherein the first coating is a gold coating.

7. An orifice plate according to claim 1, wherein the precious metal in the precious metal-polymer alloy is one of gold, rhodium and palladium.

8. An orifice plate according to claim 7 wherein the polymer in the precious metal-polymer alloy is one of Teflon, any polyimide, polymethylmethacrylate, polyethyleneterephthalate and mixtures thereof.

9. An orifice plate according to claim 8, wherein the orifice plate is coated by electrodeposition using a gold-Teflon alloy electrodeposition solution including:

an aqueous solution of potassium gold cyanide, in an amount greater than 0.5 grams per liter;

a pH-modifying substance in an amount sufficient to adjust pH of the solution to a value of less than 6;

an effective amount of suitable conducting salts for maintaining specific gravity of the solution to be greater than 15 Baume to improve conductivity of the solution; and a dispersion of Teflon particles, in an amount greater than 5 milliliters per liter.

10. An orifice plate according to claim 9, wherein:

the amount of the aqueous solution of potassium gold cyanide is from 0.5 to 2.5 grams per liter;

the amount of the pH-modifying substance is sufficient for adjusting pH to a value of from 2 to 4;

the amount of suitable conducting salts is sufficient for maintaining specific gravity of the solution from 15 to 21 Baume; and the amount of the dispersion of Teflon particles is from 5 to 25 milliliters per liter.

11. An orifice plate according to claim 8, wherein the orifice plate is of nickel and is coated by electrolyzing a solution to deposit particles from the solution onto the nickel orifice plate, the solution including:

an aqueous solution of potassium gold cyanide greater than 0.5 grams per liter;

an pH-modifying substance in an amount sufficient to adjust pH to a value of less than 6;

an effective amount of suitable conducting salts for maintaining specific gravity of the solution to be greater than 15 Baume to improve conductivity of the solution; and a dispersion of Teflon particles at a concentration greater than 5 milliliters per liter.

12. An orifice plate for an ink-jet pen comprising:

a plate having a first surface and an opposing second surface;

a plurality of spaced-apart orifices, each of which extends directly through the plate between the first surface and the second surface to define an inlet and an outlet on the first surface and the second surface respectively; and least an exposed coating of a precious metal-polymer alloy over at least portions of the second surface surrounding the outlets, wherein the coating is electrodeposited using an electrodeposition solution including:

a carrier of ions of a precious metal;

an acid buffer for maintaining the pH of the solution to be less than 6;

suitable conducting salts for maintaining the specific gravity of the solution to be greater than 10 Baume to improve conductivity of the electrodeposition solution; and a dispersion of polymer particles.

13. An orifice plate according to claim 12, wherein the polymer particles includes particles of one of Teflon, any polyamide, polymethylmethacrylate, polyethyleneterephthalate or mixtures thereof.

14. An orifice plate according to claim 12, wherein the polymer particles are less than 0.3 microns in diameter.

* * * * *